US007461457B2

(12) United States Patent
Liverman et al.

(10) Patent No.: US 7,461,457 B2
(45) Date of Patent: Dec. 9, 2008

(54) PRECISION CORNER POST CUTTER

(75) Inventors: Ivan Neil Liverman, Middlesex, NC (US); Robert Tucker Sanders, Holly Springs, NC (US); Eric Allen Stegner, Durham, NC (US); Robert William Stegner, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 291 days.

(21) Appl. No.: 11/303,775

(22) Filed: Dec. 16, 2005

(65) Prior Publication Data

US 2007/0137445 A1 Jun. 21, 2007

(51) Int. Cl.
*B26B 13/00* (2006.01)
*B26D 1/00* (2006.01)

(52) U.S. Cl. ..... 30/228; 30/180; 30/182; 30/241; 83/467.1; D8/61

(58) Field of Classification Search ..... 83/13, 83/467.1, 581, 588, 618, 639.1, 694, 451, 83/465, 466.1, 628, 631; 30/229, 233, 228, 30/192, 241, 227.4, 292, 243, 183, 180, 216, 30/92, 182; 119/610; D8/61, 69, 68, 53, D8/54; 173/170; 72/453.16, 453.3, 454; 74/424.71; 192/141, 143

See application file for complete search history.

(56) References Cited

U.S. PATENT DOCUMENTS

| | | | | |
|---|---|---|---|---|
| 1,721,182 | A | 7/1929 | Jensen | |
| 3,126,781 | A | 3/1964 | Hall | |
| 3,150,551 | A | 9/1964 | Spengler et al. | |
| 4,265,156 | A | 5/1981 | Stubbings | 83/530 |
| 4,641,431 | A * | 2/1987 | Leming et al. | 30/276 |
| 4,662,207 | A * | 5/1987 | McDonald | 72/453.7 |
| 4,747,212 | A * | 5/1988 | Cavdek | 30/92 |
| 5,125,158 | A * | 6/1992 | Casebolt et al. | 30/228 |
| 5,150,523 | A * | 9/1992 | McCurry | 30/228 |
| 5,711,078 | A * | 1/1998 | Patton et al. | 30/228 |
| 5,974,926 | A | 11/1999 | Kimura | 83/451 |
| 6,277,135 | B1 * | 8/2001 | Wang | 606/179 |
| 2003/0029295 | A1 * | 2/2003 | Yoshimizu et al. | 83/697 |
| 2003/0037933 | A1 * | 2/2003 | Breneman et al. | 172/14 |

* cited by examiner

*Primary Examiner*—Ghassem Alie
(74) *Attorney, Agent, or Firm*—Duke W. Yee; Mark E. McBurney; Houda El-Jarrah

(57) ABSTRACT

An apparatus and method are disclosed for cutting a corner post. The apparatus includes a blade disposed within the apparatus. A piston is coupled to the blade for actuating the blade. A trigger switch is coupled to the piston. The piston causes the blade to actuate when the trigger is depressed. The apparatus includes an opening through the apparatus for receiving the corner post through the opening. The blade is actuated to move through the opening and cut through the corner post.

2 Claims, 3 Drawing Sheets

PRECISION CORNER POST CUTTER

BACKGROUND OF THE INVENTION

1. Field of the Invention

The present invention relates in general to the field of shipment packaging, and in particular to unitized loads. Still more particularly, the present invention relates to a precision corner post cutting tool for efficiently, safely, and uniformly cutting corner posts that are used to secure and protect packaging.

2. Description of the Related Art

Large and heavy products, such as computer servers, are typically shipped to a customer on a pallet. These products are usually stacked on the pallet to form a single palletized load that is one unit. Corner posts are typically used to stabilize the products, such as by aligning the products with the pallet so that the packages will not shift during movement of the palletized unit.

A corner post is a rigid paper product which provides unitization of loads, edge protection, and can provide several benefits when properly installed. For example, corner posts prevent costly damage to the edges of the products. Corner posts add stiffness and support to pallet loads. Corner posts provide containment and load stabilization for products that are not rigid or do not nest efficiently when placed on a pallet.

Once the products are placed on the pallet, a corner post is cut so that it is the vertical height of the entire palletized load. The length of the corner post depends on the height of the palletized unit. A corner post is then used on each vertical edge of the palletized load to stabilize the unit.

A corner post may also be used on the horizontal edges of the palletized load. In this case, the corner post is cut so that it is the length of each horizontal side of the palletized load.

Standard length corner posts are available. Rarely, however, is a palletized load the same vertical height of one of the standard length corner posts. Thus, the corner post should be cut to the proper length for optimal performance. Known methods in the prior art for cutting corner posts to the proper length include manual methods requiring an operator to use a device, such as a handheld or table saw, to cut the corner post to the proper length. Because a manual method is used to cut corner posts, the lengths of the corner posts that are used for the palletized unit may be inconsistent. Because the method is manual, the edges may be rough and/or jagged.

FIG. 1 depicts products that are packaged together to form a single palletized load 100 where the products are secured together using corner posts in accordance with the prior art. Individual products 102 are stacked on a pallet 104. The individual products 102 are secured and stabilized using corner posts 106.

After products 102 are placed on pallet 104, a corner post must be cut that is the vertical length 108 of palletized load 100. As described above, once the proper length of the corner post is determined, a manual method is used to cut the four corner posts for palletized load 100.

BRIEF SUMMARY OF THE INVENTION

In response to the shortcomings of the prior art system described, an illustrative embodiment of the present invention is thus directed to an apparatus and method for cutting corner posts. The apparatus includes a blade disposed within the apparatus. A piston is coupled to the blade for actuating the blade. A trigger switch is coupled to the piston. The piston causes the blade to actuate when the trigger is depressed. The apparatus includes an opening through the apparatus for receiving the corner post through the opening. The blade is actuated to move through the opening and cut through the corner post.

The above, as well as additional purposes, features, and advantages of the present invention will become apparent in the following detailed written description.

BRIEF DESCRIPTION OF THE SEVERAL VIEWS OF THE DRAWINGS

The novel features believed characteristic of the invention are set forth in the appended claims. The invention itself, however, as well as a preferred mode of use, further purposes and advantages thereof, will best be understood by reference to the following detailed description of an illustrative embodiment when read in conjunction with the accompanying drawings, where:

DETAILED DESCRIPTION OF THE INVENTION

Figure 1:
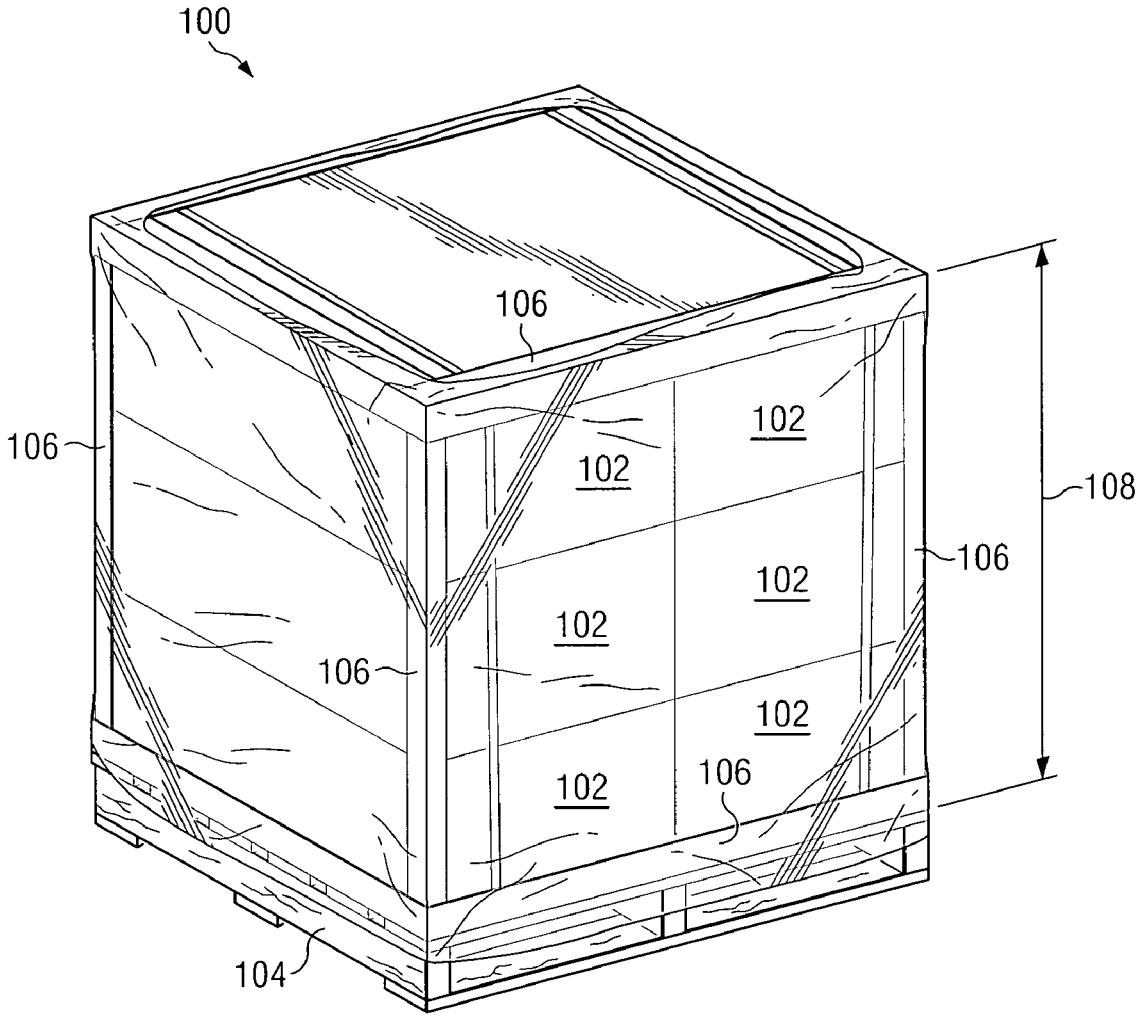
FIG. 1 (PRIOR ART)
FIG. 1 depicts products that are packaged together to form a single palletized load where the products are secured together using corner posts in accordance with the prior art.
Figure 2:
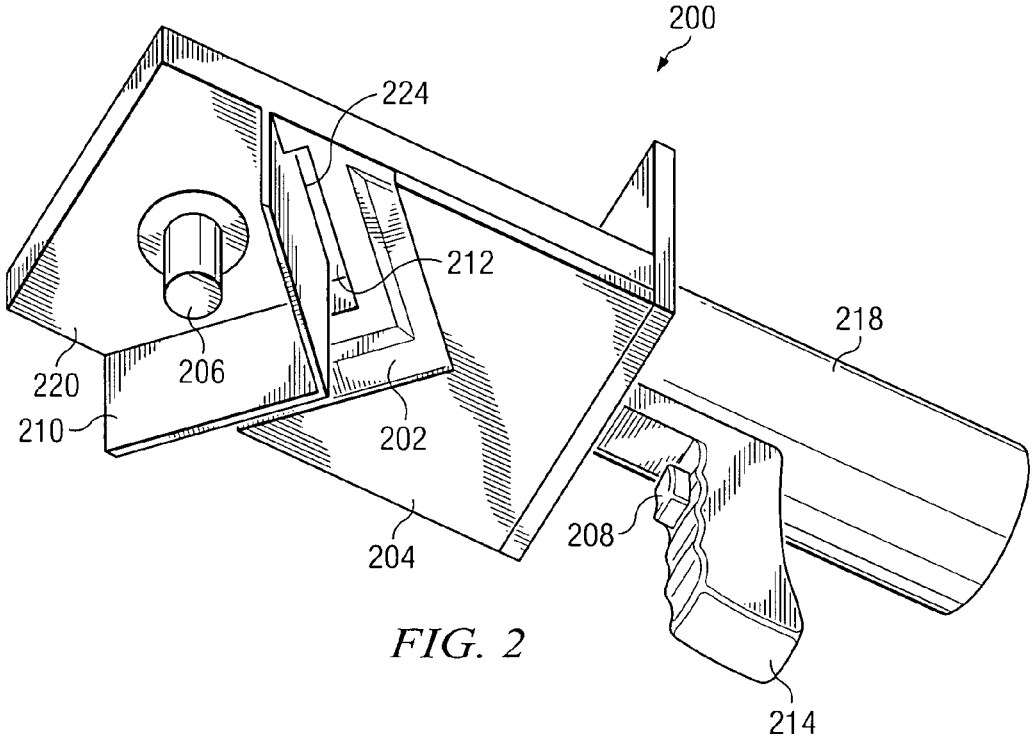
FIG. 2 depicts a bottom perspective view of an illustrative embodiment of a corner post cutting tool in accordance with an illustrative embodiment of the present invention.

FIG. 2 depicts a bottom perspective view of an illustrative embodiment of a corner post cutting tool 200 in accordance with an illustrative embodiment of the present invention. Corner post cutting tool 200 includes a blade 202 for cutting a corner post, a blade cover 204 that covers blade 202, an arm switch 206, a trigger switch 208, a guide 210, an opening 212 through which corner post cutting tool 200 receives a corner post that is to be cut, a handle 214, a piston 216 (see FIG. 3), and a cylinder 218 for housing piston 216.

Corner post cutting tool 200 is preferably a handheld device which operates using compressed air. Compressed air is received within cylinder 218, which, when released when both arm switch 206 and trigger switch 208 are simultaneously depressed, causes piston 216 to actuate blade 202. Corner post cutting tool 200 includes a blade 202 for cutting an L-shaped corner post to the desired length. Blade cover 204 is attached to bottom surface 220 of corner post cutting tool 200 and is provided to protect an operator as well as to protect blade 202.

Two different safety switches, arm switch 206 and trigger switch 208, are provided. Both the arm switch 206 and trigger switch 208 must be depressed simultaneously before blade 202 can be actuated.

A guide 210 is provided for guiding a corner post through opening 212 so that the corner post will protrude on both sides of opening 212 prior to the corner post being cut. Corner post cutting tool 200 includes a handle 214. Trigger switch 208 protrudes from handle 214. Arm switch 206 protrudes from a bottom surface 220 of cutter 200.

According to the illustrative embodiment, guide 210 is an L-shaped guide, although those skilled in the art will recognize that other shapes may be used to implement guide 210.

Figure 3:
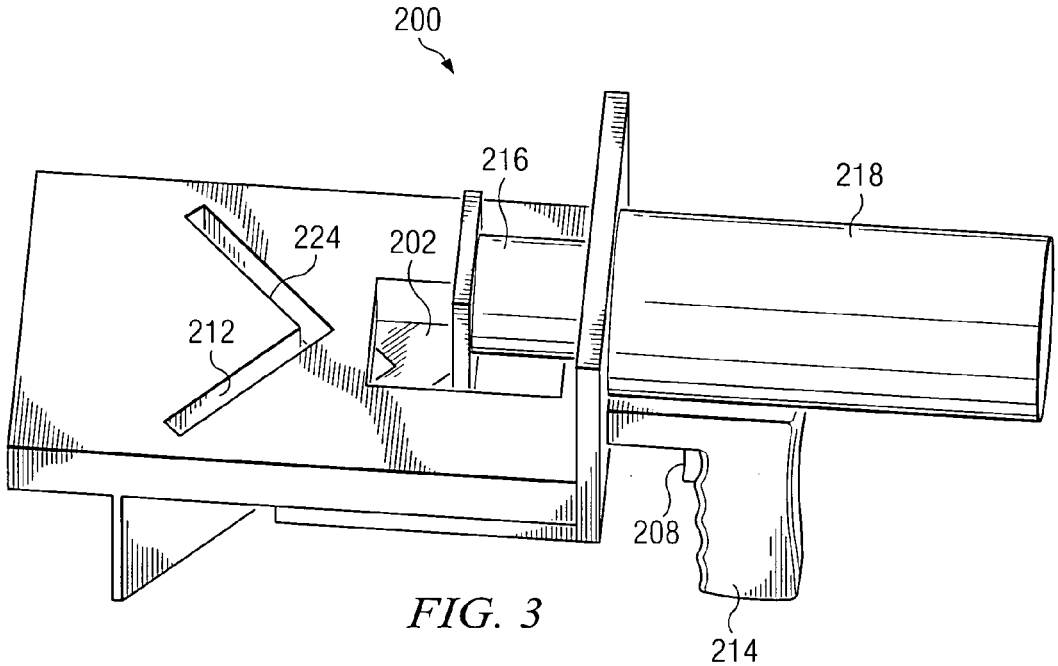
FIG. 3 illustrates a top perspective view of a corner post cutting tool in accordance with an illustrative embodiment of the present invention.

FIG. 3 illustrates a top perspective view of a corner post cutting tool in accordance with an illustrative embodiment of the present invention. A piston 216 moves within cylinder 218 to actuate blade 202 when both arm switch 206 and trigger switch 208 are simultaneously depressed.

Figure 4:
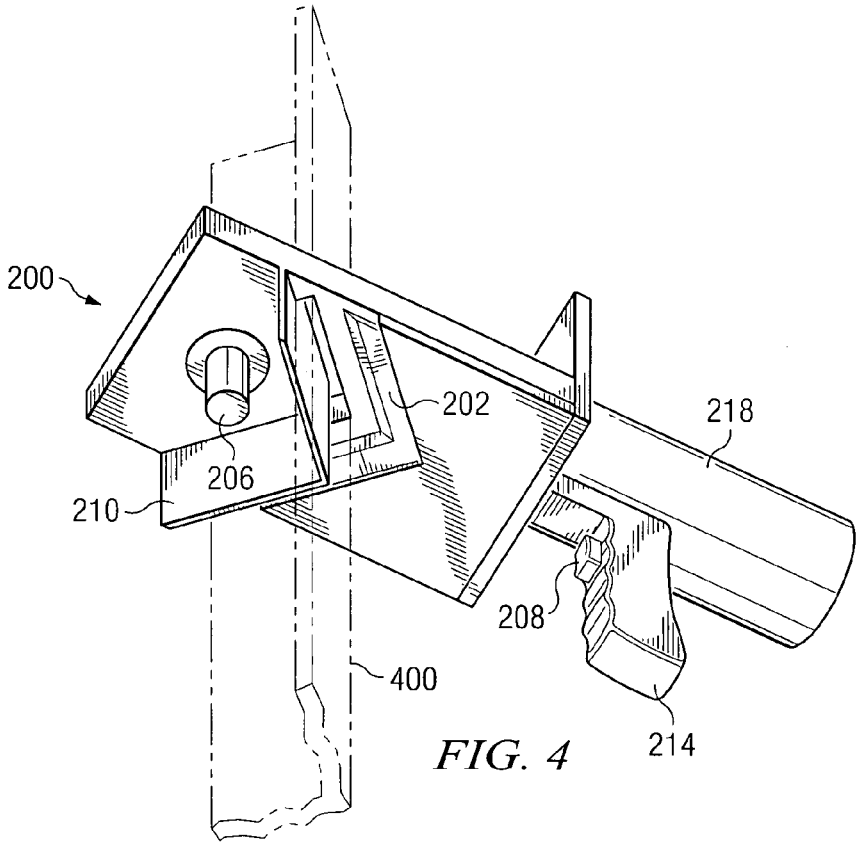
FIG. 4 depicts a perspective view of a corner post that is inserted through a corner post cutting tool in accordance with an illustrative embodiment of the present invention.

FIG. 4 depicts a top perspective view of a corner post 400 that is inserted through corner post cutting tool 200 in accordance with an illustrative embodiment of the present invention. Guide 210 assists in guiding corner post 400 through opening 212. Guide 210 extends perpendicularly from bottom surface 220. Guide 210 includes a notch 224 such that blade 202 will mate with notch 224 after blade 202 has been actuated. In this manner, blade 202 is permitted to move through opening 212 until blade 202 reaches notch 224.

Figure 5:
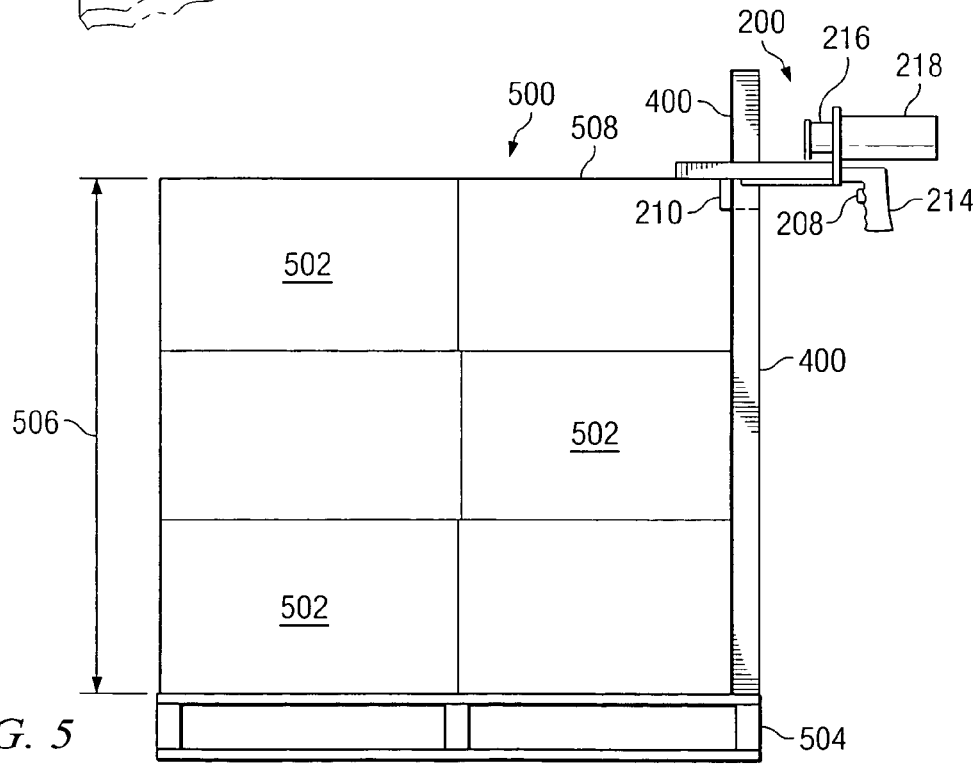
FIG. 5 illustrates a side view of a corner post cutting tool, a corner post, and a palletized load in accordance with an illustrative embodiment of the present invention.

FIG. 5 illustrates a side view of a corner post cutting tool, a corner post, and a palletized load in accordance with an illustrative embodiment of the present invention. A corner post 400 is used to stabilize palletized unit 500. Palletized unit 500 includes multiple packages 502 that are placed on pallet 504.

Corner post 400 is secured against palletized unit 500. Corner post 400 will be longer than vertical length 506 prior to corner post 400 being cut using corner post cutting tool 200. Therefore, corner post 400 needs to be cut to the proper length so that it matches vertical height 506 of palletized unit 500. Vertical height 506 is the length from the bottom of a palletized unit 500 to the top of the palletized unit 500.

In operation, corner post cutting tool 200 will slide over corner post 400 such that corner post 400 is inserted through opening 212. Corner post cutting tool 200 is then lowered onto top 508 of palletized unit 500. Arm switch 206 will be depressed when bottom surface 220 of corner post cutting tool 200 is depressed against a top surface 508 of palletized unit 500. The bottom of corner post 400 and the bottom of palletized unit 500 rest against pallet 504. When corner post cutting tool 200 is depressed against top surface 508, corner post cutting tool 200 is positioned to cut corner post 400 to the proper length, i.e. length 506, because corner post cutting tool 200 is positioned at the top of palletized unit 500. An operator will further engage arm switch 206 by applying downward force against top surface 508 of corner post cutting tool 200.

When an operator is assured that corner post cutting tool 200 is in the correct position, the operator can then cut corner post 400 by depressing trigger switch 208. Because both arm switch 206 and trigger switch 208 are now depressed simultaneously, piston 216 is actuated to move out of cylinder 218. Piston 216 is coupled to blade 202. Therefore, the movement of piston 216 will cause blade 202 to move through opening 212, and thus, cut corner post 400. Blade 202 will continue through opening 212 until it reaches notch 224.

Corner post 400 will be cut to match the vertical length 508 because corner post cutting tool 200 is placed on top 508 of palletized unit 500 when corner post 400 is cut. Corner post cutting tool 200 cuts corner posts to the exact height of the palletized unit. In this manner, corner post 400 is cut in an efficient, safe, and uniform manner.

The illustrative embodiment of the present invention solves several problems associated with the prior art such as safety of use, quality of the cut corner, consistency of corner post length, cycle time, parts inventory, and storage space. The illustrative embodiment of the present invention provides a consistent and accurate cut. It provides uniform palletized units. The corner posts can be installed faster using the illustrative embodiment of the present invention because the corner posts can be cut faster using the illustrative embodiment of the present invention than using manual methods.

The illustrative embodiment of the present invention is designed to ensure hazard-free operation. Two safety switches are provided that must be depressed simultaneously in order for the blade to actuate.

The illustrative embodiment of the present invention permits standard-sized corner posts to be purchased. These standard-sized corner posts can then be cut to fit a variety of sizes of palletized loads. Costs are reduced by reducing the number of custom sizes of corner posts that need to be purchased.

The illustrative embodiment of the present invention reduces scrap corner post products because the illustrative embodiment of the present invention provides a cleaner cutting method as compared to the prior art methods. Because the illustrative embodiment of the present invention makes a cleaner cut through the corner post, excess corner post pieces can be reused for other palletized loads.

The illustrative embodiment of the present invention cuts corner posts to the exact height of the palletized unit in a consistent, safe, and effective manner. It eliminates the need for an operator to manually cut a corner post, thereby reducing the amount of time required to install the corner posts on the palletized unit.

While the invention has been particularly shown and described with reference to a preferred embodiment, it will be understood by those skilled in the art that various changes in form and detail may be made therein without departing from the spirit and scope of the invention.

What is claimed is:

1. A handheld apparatus for cutting a corner post of a palletized unit, said handheld apparatus comprising:

a support plate;

an L-shaped blade disposed between the support plate and a blade cover, said L-shaped blade utilized for cutting said corner post, wherein said handheld apparatus receives said corner post through an L-shaped opening disposed between an L-shaped guide and the L-shaped blade while the apparatus is lowered onto the top surface of the palletized unit;

said L-shaped guide depending perpendicularly from a bottom surface of said handheld apparatus, wherein said guide includes a notch for mating said guide with said blade after said blade has been actuated;

said blade cover, wherein said blade cover covers said L-shaped blade, wherein said blade cover is attached to a bottom surface of said support plate for protecting an operator and the blade;

a piston coupled to said blade for actuating said blade;

a cylinder, said cylinder for receiving said piston when said piston is not actuating said blade;

a trigger switch coupled to said piston, said piston causing said blade to actuate when said trigger switch is depressed, and wherein said trigger switch is coupled to a handle of said handheld apparatus;

a second switch coupled to the bottom surface of said support plate, wherein said blade is actuated only when said second switch and said trigger switch are depressed simultaneously and when said second switch is pressed against said top surface of said palletized unit; and said blade being disposed below the L-shaped opening, wherein said blade moves parallel to the opening and perpendicular to the corner post, wherein the corner post is formed of paper and said corner post is L-shaped.

2. The handheld apparatus according to claim 1, wherein the L-shaped guide is utilized for guiding said corner post through said L-shaped opening.

* * * * *